US005665692A

United States Patent [19]

Kaminsky

[11] Patent Number: 5,665,692

[45] **Date of Patent: *Sep. 9, 1997**

[54] PROCESS FOR PRODUCING DETERGENT AGGLOMERATES IN WHICH PARTICLE SIZE IS CONTROLLED

[75] Inventor: George John Kaminsky, Cincinnati, Ohio

[73] Assignee: The Procter & Gamble Company, Cincinnati, Ohio

[ * ] Notice: The term of this patent shall not extend beyond the expiration date of Pat. No. 5,574,005.

[21] Appl. No.: 682,339

[22] Filed: Jul. 25, 1996

Related U.S. Application Data

[63] Continuation of Ser. No. 387,956, Feb. 13, 1995, abandoned.

[51] Int. Cl.[6] ..... C11D 11/00; C11D 1/37; C11D 3/10

[52] U.S. Cl. ..... 510/444; 510/446; 510/475; 510/498; 510/507; 510/509; 264/117; 264/140; 23/313 R

[58] Field of Search ..... 510/444, 446, 510/475, 498, 507, 509; 264/117, 140; 23/313 R

[56] References Cited

U.S. PATENT DOCUMENTS

| | | | |
|---|---|---|---|
| 3,867,316 | 2/1975 | Frank et al. | 252/545 |
| 4,384,978 | 5/1983 | Ploog et al. | 252/353 |
| 4,435,317 | 3/1984 | Gerritsen et al. | 252/547 |
| 4,482,470 | 11/1984 | Reuter et al. | 252/162 |
| 4,487,710 | 12/1984 | Kaminsky | 252/546 |
| 4,664,817 | 5/1987 | Wixon | 252/8.8 |
| 4,692,271 | 9/1987 | Messenger et al. | 252/354 |
| 4,828,721 | 5/1989 | Bollier et al. | 252/8.7 |
| 4,919,847 | 4/1990 | Barletta et al. | 252/558 |
| 5,108,646 | 4/1992 | Beerse et al. | 252/174.25 |
| 5,133,924 | 7/1992 | Appel et al. | 264/342 R |
| 5,160,657 | 11/1992 | Bortolotti et al. | 252/174.14 |
| 5,205,958 | 4/1993 | Swatling et al. | 252/174.13 |
| 5,354,493 | 10/1994 | Wilms | 252/174.21 |
| 5,366,652 | 11/1994 | Capeci et al. | 252/89.1 |
| 5,490,954 | 2/1996 | Van Der Hoeven et al. | 252/550 |
| 5,496,486 | 3/1996 | Staley | 252/89.1 |
| 5,574,005 | 11/1996 | Welch et al. | 510/444 |

FOREIGN PATENT DOCUMENTS

| | | |
|---|---|---|
| 0 110 731 A2 | 6/1984 | European Pat. Off. . |
| 0 351 937 A1 | 1/1990 | European Pat. Off. . |
| 390 251 A3 | 10/1990 | European Pat. Off. . |
| 0 402 112 A2 | 12/1990 | European Pat. Off. . |
| 0 402 112 A3 | 12/1990 | European Pat. Off. . |
| 420 317 A1 | 4/1991 | European Pat. Off. . |
| 0 451 894 A1 | 10/1991 | European Pat. Off. . |
| 0 504 986 A2 | 9/1992 | European Pat. Off. . |
| 508 543 A1 | 10/1992 | European Pat. Off. . |
| 69-072999A | 4/1985 | Japan . |
| 61-118500A | 6/1986 | Japan . |
| 1 517 713 | 7/1978 | United Kingdom . |
| WO 92/01036 | 1/1992 | WIPO . |
| WO 92/02609 | 2/1992 | WIPO . |
| WO 92/18602 | 10/1992 | WIPO . |
| WO 93/18123 | 9/1993 | WIPO . |
| WO 94/03568 | 2/1994 | WIPO . |
| WO 95/32276 | 11/1995 | WIPO . |

*Primary Examiner*—Christine Skane
*Assistant Examiner*—Lorna M. Douyon
*Attorney, Agent, or Firm*—Ken K. Patel; Jacobus C. Rasser; Jerry J. Yetter

[57] ABSTRACT

A process wherein the particle size of high density detergent agglomerates produced via agglomeration of a high active surfactant paste can be effectively and inexpensively controlled. More particularly, the process invention includes the step of regulating the level of carbonate in a highly active surfactant paste which is combined with other detergent ingredients in an agglomeration process. The agglomeration process also includes the step of treating the surfactant paste and other detergent ingredients in a high speed mixer/densifier followed by a low or moderate speed mixer/densifier resulting in detergent agglomerates.

12 Claims, No Drawings

PROCESS FOR PRODUCING DETERGENT AGGLOMERATES IN WHICH PARTICLE SIZE IS CONTROLLED

This is a continuation of application Ser. No. 08/387,956, filed on Feb. 13, 1995 now abandoned.

FIELD OF THE INVENTION

The present invention generally relates to a process for producing detergent agglomerates suitable for use as a detergent composition or as an admix component for a fully formulated composition. More specifically, the process produces high density detergent agglomerates which have a controlled median particle size by regulating the level of sodium carbonate in the high active surfactant paste used in forming the agglomerates.

BACKGROUND OF THE INVENTION

Recently, there has been considerable interest within the detergent industry for laundry detergents which are "compact" and therefore, have low dosage volumes. To facilitate production of these so-called low dosage detergents, many attempts have been made to produce high bulk density detergents, for example with a density of 600 g/l or higher. The low dosage detergents are currently in high demand as they conserve resources and can be sold in small packages which are more convenient for consumers.

Generally, them are two primary types of processes by which detergent granules or powders can be prepared. The first type of process involves spray-drying an aqueous detergent slurry in a spray-drying tower to produce highly porous detergent granules. In the second type of process, the various detergent components are dry mixed after which they are agglomerated with a binder such as a nonionic or anionic surfactant. In both processes, the most important factors which govern the density of the resulting detergent granules are the density, porosity and surface area of the various starting materials and their respective chemical composition. These parameters, however, can only be varied within a limited range. Thus, a substantial bulk density increase can only be achieved by additional processing steps which lead to densification of the detergent granules.

The art is replete with processes directed primarily to densifying or otherwise processing spray dried granules. Currently, the relative amounts and types of materials subjected to spray drying processes in the production of detergent granules has been limited. For example, it has been difficult to attain high levels of surfactant in the resulting detergent composition, a feature which facilitates production of low dosage detergents. Thus, those skilled in the art have striven for ways in which detergent compositions can be produced without having the limitations imposed by conventional spray drying techniques. To that end, the art is also replete with disclosures of processes which entail agglomerating detergent compositions. For example, attempts have been made to agglomerate detergent builders by mixing zeolite and/or layered silicates in a mixer to form free flowing agglomerates. While such attempts suggest that their process can be used to produce detergent agglomerates, they do not provide a mechanism by which starting detergent materials in the form of high active surfactant pastes and dry materials can be effectively agglomerated into crisp, free flowing, highly dense detergent agglomerates.

Additionally for purposes of insuring consumer satisfaction, it is important for the resulting agglomerates to have a controlled median particle size such that the detergent agglomerates do not segregate by size in the final detergent product box. However, controlling the particle size of the agglomerates in typical agglomeration processes has been a problem since the particle size ultimately formed is extremely sensitive to slight variations in a wide range of process factors such as equipment operating temperatures, and the temperature and compositions of the detergent ingredients. This problem is especially exacerbated in the event that certain highly viscous surfactant pastes are used in the agglomeration process. Such surfactant pastes lend themselves to being affected by environmental factors before and during processing, all of which cause great fluctuations in the ultimate size of the resulting agglomerates. As a consequence, it would be desirable to have an inexpensive method by which the agglomerate particle size can be effectively controlled, especially in large-scale production facilities.

Accordingly, despite the above-described disclosures in the art, there remains a need for a process for effectively regulating the particle size of high density detergent agglomerates produced by an agglomeration process which produces such agglomerates directly from starting detergent ingredients. Also, there remains a need for such a process which is inexpensive and can be easily incorporated into large-scale production facilities for low dosage or compact detergents.

BACKGROUND ART

The following references are directed to surfactant pastes: Aouad et at, WO 93/18123 (Procter & Gamble), Aouad et al, WO 92/18602 (Procter & Gamble), and Van Zorn et al, EP 504,986 (Shell). The following references are directed to densifying spray-dried granules: Appel et al, U.S. Pat. No. 5,133,924 (Lever); Bortolotti et at, U.S. Pat. No. 5,160,657 (Lever); Johnson et at, British patent No. 1,517,713 (Unilever); and Curtis, European Patent Application 451, 894. The following references are directed to producing detergents by agglomeration: Capeci et at, U.S. Pat. No. 5,366,652 (Procter & Gamble); Beerse et al, U.S. Pat. No. 5,108,646 (Procter & Gamble); Hollingsworth et at, European Patent Application 351,937 (Unilever); and Swatling et al, U.S. Pat. No. 5,205,958.

SUMMARY OF THE INVENTION

The present invention meets the aforementioned needs in the art by providing a process which provides a means by which the particle size of high density detergent agglomerates produced via agglomeration of a high active surfactant paste can be effectively and inexpensively controlled. More particularly, the process invention defined herein includes the step of regulating the level of carbonate in a highly active surfactant paste which is combined with other detergent ingredients in an agglomeration process. The agglomeration process includes the step of treating the surfactant paste and other detergent ingredients in a high speed mixer/densifier followed by a low or moderate speed mixer/densifier resulting in detergent agglomerates. The particle size of the agglomerates in such processes are very sensitive to any sort of change in operating parameters. It has been found, however, that regulating the level of carbonate in the surfactant paste itself unexpectedly provides a "lever" for adjusting the particle size of the agglomerates. Further, it has been found that the level adjustment (i.e. either increasing or decreasing) of carbonate is surprisingly the opposite to what the skilled artisan would predict.

As used herein, the term "agglomerates" refers to particles formed by agglomerating detergent granules or particles which typically have a smaller mean particle size than the formed agglomerates. As used herein, the phrase "at least a minor amount" of water means an amount sufficient to aid in agglomeration, typically on the order of 0.5% to about 10% by weight of the total amount of water contained in the mixture of all starting components. All documents referenced herein are incorporated by reference and all percentages used herein are expressed as "percent-by-weight" unless indicated otherwise. All viscosities described herein are measured at 70° C. and at shear rates between about 10 to 50 $sec^{-1}$, preferably at 25 $sec^{-1}$.

In accordance with one aspect of the invention, a process for preparing detergent agglomerates for use as a detergent composition or an admix therefore is provided. The process comprises the steps of: (a) inputting from about 1% to about 70% by weight of a detergency builder into a high speed mixer/densifier; (b) charging a viscous surfactant paste into the high speed mixer/densifier, wherein the surfactant paste includes, by weight of the surfactant paste, from about 70% to 95% of a detersive surfactant and from about 5% to about 30% of water; (c) agglomerating the surfactant paste and the builder by treating the surfactant paste and the builder initially in the high speed mixer/densifier and subsequently in a moderate speed mixer/densifier so as to form detergent agglomerates having a predetermined particle size range; and (d) regulating the detergent agglomerates within the predetermined particle size range by increasing the amount of sodium carbonate in the surfactant paste from about 0% to about 5%, by weight of the surfactant paste, to reduce the particle size of the detergent agglomerates, and decreasing the amount of the sodium carbonate in the surfactant paste to enlarge the particle size of the detergent agglomerates within the predetermined particle size range.

In another aspect of the invention, another more preferred embodiment of the process is provided. This process comprising the steps of: (a) inputting from about 0.5% to about 40% by weight of an aluminosilicate and from about 5% to about 30% by weight of a first carbonate material into a high speed mixer/densifier; (b) charging a viscous surfactant paste into the high speed mixer/densifier, wherein the surfactant paste includes, by weight of the surfactant paste, from about 70% to 75% of a detersive surfactant mixture of alkyl sulfate and linear alkylbenzene sulfonate and from about 15% to about 25% of water; (c) agglomerating the surfactant paste and the builder by treating the surfactant paste, the first carbonate material, and the aluminosilicate initially in the high speed mixer/densifier and subsequently in a moderate speed mixer/densifier so as to form detergent agglomerates having a predetermined particle size range; and (d) regulating the detergent agglomerates within the predetermined particle size range by increasing the amount of a second carbonate material from about 0.5% to about 1.5%, by weight of the surfactant paste, to reduce the particle size of the detergent agglomerates, and decreasing the amount of the second carbonate material in the surfactant paste to enlarge the particle size of the detergent agglomerates within the predetermined particle size range.

The invention also provides detergent products which include agglomerates produced by any of the processes described herein.

Accordingly, it is an object of the invention to provide a process for effectively regulating the particle size of high density detergent agglomerates produced by an agglomeration process which produces such agglomerates directly from starting detergent ingredients. It is also an object of the invention to provide such a process which is inexpensive and can be easily incorporated into large-scale production facilities for low dosage or compact detergents. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

The present invention is directed to a process which produces free flowing, high density detergent agglomerates, preferably having a density of at least 650 g/l. The process produces high density detergent agglomerates from a highly viscous surfactant paste having a relatively low water content, typically at least about 5%. Generally, the present process is used in the production of low dosage detergents whereby the resulting detergent agglomerates can be used as a detergent or as a detergent additive. In particular, the process can be used to form "high active" (i.e. high surfactant level) detergent agglomerates which are used as an admix for purposes of enhancing the active levels in granular low dosage detergents and thereby allow for more compact detergents. While not intended to be bound by theory, one skilled in the art would expect that introducing higher carbonate levels (at a constant water amount) into a highly viscous, low water-content, surfactant paste would substantially raise the pH leading to increased "stickyness" and inevitably, much larger particles. However, it has been found that the opposite is true in that higher carbonate levels in the paste used herein results in smaller agglomerates. It should be understood that the process described herein can be continuous or batch depending upon the desired application.

Process

Initially, the present process entails inputting from about 1% to about 70%, more preferably from about 5% to about 70% and, most preferably from about 50% to about 70%, by weight of a detergency builder into the high speed mixer/densifier. The detergency builder is preferably an anhydrous material which can absorb at least a minor amount of the water from the surfactant paste. In a preferred embodiment, the detergency builder is from about 0.5% to about 40% by weight of aluminosilicate and from about 0.5% to about 30% by weight of a carbonate material, preferably sodium carbonate. Other detergent ingredients may also be inputted to the high speed mixer/densifier as described hereinafter, as well.

In another step of the process, a high active, viscous surfactant paste is fed into a high speed mixer/densifier for agglomeration. The surfactant paste comprises, by weight of the paste, from about 70% to about 95%, preferably from about 70% to about 75%, of a detersive surfactant, and from about 5% to about 30%, preferably from about 15% to about 25%, of water. Other minor ingredients such as polyethylene glycol in an amount of from about 0.1% to about 10%, by weight of the paste, can also be included in the high active surfactant paste. In a preferred embodiment, the surfactant paste is a mixture of alkyl sulfate ("AS") and linear alkylbenzene sulfonate ("LAS") surfactants in a weight ratio of from about 1:1 to about 5:1 (AS:LAS). Another preferred embodiment herein contemplates a surfactant paste mixture having a weight ratio of alkyl sulfate to linear alkylbenzene sulfonate of about 3:1.

The surfactant paste, builder and other optional staring detergent materials are sent to a moderate speed mixer/densifier for further build-up agglomeration resulting in agglomerates having a predetermined particle size and density of at least 650 g/l and, more preferably from about 700 g/l to about 900 g/l. The nature and composition of the surfactant paste, builder and other starting detergent materials can vary as described in detail hereinafter. Preferably, the mean residence time of the surfactant paste and other starting detergent materials in the high speed mixer/densifier (e.g. Lödige Recycler CB30) is from about 1 to 30 seconds while the residence time in low or moderate speed mixer/densifier (e.g. Lödige Recycler KM 300 "Ploughshare") is from about 0.25 to 10 minutes.

The predetermined median particle size of the resulting detergent agglomerates is from about 300 microns to about 700 microns, preferably from about 400 microns to about 600 microns, and most preferably from about 300 microns to about 400 microns. It is this target or predetermined particle size range which is necessary to insure uniformity in the detergent agglomerates ultimately packaged in the detergent product. Segregation of the agglomerates by size is greatly reduced if most or all of the agglomerates are within the predetermined particle size range. As mentioned previously, it has been found that regulating the carbonate level in the surfactant paste itself, either at the paste manufacturing site and/or at the detergent manufacturing site provides a convenient "lever" for controlling the agglomerate particle size. However, this regulating step relies heavily on the finding that an increase in carbonate level in the paste results in a lowering of the ultimate agglomerate particle size, and a decrease in the carbonate level results in a larger particle size. This is clearly unexpected since one skilled in the art would predict that higher carbonate levels would increase particle size and a decreased particle size with lower carbonate levels.

In this regulating step, the amount of carbonate incorporated into fire surfactant paste is preferably from about 0% to about 5%, more preferably from about 0.5% to about 1%, and most preferably from about 0.6% to about 1%, by weight of the surfactant paste. Preferably, the carbonate is selected from the group consisting of sodium carbonate, calcium carbonate, potassium carbonate and mixtures thereof. The most preferred carbonate is sodium carbonate. Those skilled in the art should appreciate that this carbonate material is added to the paste itself apart from any carbonate material used as the detergency builder mentioned above.

Inevitably, a certain amount of the agglomerates exiting the moderate speed mixer/densifier will be below the predetermined particle size range and optionally, can be screened and recycled back to the high speed mixer/densifier for further build-up agglomeration. In that regard, these so-called undersized agglomerates or "fines" will comprise from about 5% to about 30% by weight of the detergent agglomerates.

The detergent agglomerates produced by the process preferably have a surfactant level of from about 25% to about 55%, more preferably from about 35% to about 55% and, most preferably from about 45% to about 55%. Such detergent agglomerates are particularly useful in the production of low dosage detergents. The particle porosity of the resulting detergent agglomerates produced according to the process of the invention is preferably in a range from about 5% to about 20%, more preferably at about 10%. The combination of the above-referenced porosity and particle size results in agglomerates having density values of 650 g/l and higher. Such a feature is especially useful in the production of low dosage laundry detergents as well as other granular compositions such as dishwashing compositions.

The process can comprise the step of spraying an additional binder in the mixer/densifier(s) used in the agglomeration step to facilitate production of the desired detergent agglomerates. A binder is added for purposes of enhancing agglomeration by providing a "binding" or "sticking" agent for the detergent components. The binder is preferably selected from the group consisting of water, anionic surfactants, nonionic surfactants, polyethylene glycol, polyacrylates, citric acid and mixtures thereof. Other suitable binder materials including those listed herein are described in Beerse et al, U.S. Pat. No. 5,108,646 (Procter & Gamble Co.), the disclosure of which is incorporated herein by reference.

Another optional step contemplated by the present process includes conditioning the detergent agglomerates by drying the detergent agglomerates after the moderate speed mixer/densifier. Yet another optional step involves adding a coating agent to improve flowability after they exit the mixer/densifier(s) used in agglomeration. This furthers enhances the condition of the detergent agglomerates for use as an additive or to place them in shippable or packagable form. Those skilled in the art will appreciate that a wide variety of methods may be used to dry as well as cool the exiting detergent agglomerates without departing from the scope of the invention. By way of example, apparatus such as a fluidized bed can be used for drying while an airlift can be used for cooling should it be necessary.

Surfactant Paste

The viscous surfactant paste used in the process has a viscosity of from about 5,000 cps to about 100,000 cps, more preferably from about 7,500 cps to about 75,000 cps. As mentioned previously, the viscosity is measured at 70° C. and at shear rates of about 10 to 50 sec.$^{-1}$, preferably at 25 sec.$^{-1}$. Furthermore, the surfactant comprises from about 70% to about 95%, more preferably from about 75% to about 85% of a detersive surfactant, and the balance water and other conventional detergent ingredients.

The surfactant can be selected from anionic, nonionic, zwitterionic, ampholytic and cationic classes and compatible mixtures thereof. Detergent surfactants useful herein are described in U.S. Patent No. 3,664,961, Norris, issued May 23, 1972, and in U.S. Pat. No. 3,919,678, Laughlin et at., issued Dec. 30, 1975, both of which are incorporated herein by reference. Useful cationic surfactants also include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference. Of the surfactants, anionics and nonionic are preferred and anionics are most preferred.

The following are representative examples of detergent surfactants useful in the present surfactant paste. Water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional anionic surfactants which suitable for use herein include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{8-18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$ LAS.

Other anionic surfactants suitable for use herein are the sodium alkyl glyceryl ether sulfonates, especially those ethers of higher alcohols derived from tallow and coconut oil; sodium coconut oil fatty acid monoglyceride sulfonates and sulfates; sodium or potassium of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

In addition, suitable anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Preferred anionic surfactants are $C_{10-18}$ linear alkylbenzene sulfonate and $C_{10-8}$ alkyl sulfate. If desired, low moisture (less than about 25% water) alkyl sulfate paste can be the sole ingredient in the surfactant paste. Most preferred are $C_{10-18}$ alkyl sulfates, linear or branched, and any of primary, secondary or tertiary. A preferred embodiment of the present invention is wherein the surfactant paste comprises from about 20% to about 40% of a mixture of sodium $C_{10-13}$ linear alkylbenzene sulfonate and sodium $C_{12-16}$ alkyl sulfate in a weight ratio of about 2:1 to 1:2. Another preferred embodiment of the detergent composition includes a mixture of $C_{10-18}$ alkyl sulfate and $C_{10-18}$ alkyl ethoxy sulfate in a weight ratio of about 80:20.

Water-soluble nonionic surfactants are also useful in the instant invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol. Included are the water-soluble and water-dispersible condensation products of aliphatic alcohols containing from 8 to 22 carbon atoms, in either straight chain or branched configuration, with from 3 to 12 moles of ethylene oxide per mole of alcohol.

An additional group of nonionics suitable for use herein are semi-polar nonionic surfactants which include water-soluble amine oxides containing one alkyl moiety of from abut 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)_nOH$, wherein $R^1$ is a $C_{10}$–$C_{16}$ alkyl group or a $C_8$–$C_{12}$ alkyl phenyl group, and n is from 3 to about 80. Particularly preferred are condensation products of $C_{12}$–$C_{15}$ alcohols with from about 5 to about 20 moles of ethylene oxide per mole of alcohol, e.g., $C_{12}$–$C_{13}$ alcohol condensed with about 6.5 moles of ethylene oxide per mole of alcohol.

Additional suitable nonionic surfactants include polyhydroxy fatty acid amides of the formula

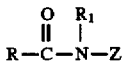

wherein R is a $C_{9-17}$ alkyl or alkenyl, $R_1$ is a methyl group and Z is glycityl derived from a reduced sugar or alkoxylated derivative thereof. Examples are N-methyl N-1-deoxyghicityl cocoamide and N-methyl N-1-deoxyglucityl oleamide. Processes for making polyhydroxy fatty acid amides are known and can be found in Wilson, U.S. Pat. No. 2,955,576 and Schwartz, U.S. Pat. No. 2,703,798, the disclosures of which are incorporated herein by reference.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present invention. Cationic surfactants comprise a wide variety of compounds characterized by one or more organic hydrophobic groups in the cation and generally by a quaternary nitrogen associated with an acid radical. Pentavalent nitrogen ting compounds are also considered quaternary nitrogen compounds. Suitable anions are halides, methyl sulfate and hydroxide. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Cationic surfactants are often used in detergent compositions to provide fabric softening and/or antistatic benefits.

Antistatic agents which provide some softening benefit and which are preferred herein are the quaternary ammonium salts described in U.S. Pat. No. 3,936,537, Baskerville, Jr. et al., issued Feb. 3, 1976, the disclosure of which is incorporated herein by reference.

Detergency Builder

The starting detergent ingredients of the present process can, and preferably do, also comprise a detergent builder. Builders are generally selected from the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Preferred are the alkali metal, especially sodium, salts of the above. Preferred for use herein are the phosphates, carbonates, silicates, $C_{10-18}$ fatty acids, polycarboxylates, and mixtures thereof. More preferred are sodium tripolyphosphate, tetrasodium pyrophosphate, citrate, tartrate mono- and di-succinates, sodium silicate, and mixtures thereof (see below).

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diane tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid. Some of these materials are useful as the water-soluble anionic polymer as hereinafter described, but only if in intimate admixture with the non-soap anionic surfactant.

Other suitable polycarboxylates for use herein are the polyacetal carboxylates described in U.S. Pat. No. 4,144,226, issued Mar. 13, 1979 to Crutchfield et at, and U.S. Pat. No. 4,246,495, issued Mar. 27, 1979 to Crutchfield et at, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et at., issued May 5, 1987, the disclosure of which is incorporated herein by reference.

Water-soluble silicate solids represented by the formula $SiO_2.M_2O$, M being an alkali metal, and having a $SiO_2:M_2O$ weight ratio of from about 0.5 to about 4.0, are useful salts in the detergent granules of the invention at levels of from about 2% to about 15% on an anhydrous weight basis, preferably from about 3% to about 8%. Anhydrous or hydrated particulate silicate can be utilized, as well.

Optional Detergent Components

The starting or entering detergent components in the present process can also include any number of additional ingredients. These include other detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et at., incorporated herein by reference.

Bleaching agents and activators are described in U.S. Pat. No. 4,412,934, Chung et at., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et at., from Column 17, line 54 through Column 18, line 68, incorporated herein by reference. Suds modifiers are also optional ingredients and are described in U.S. Pat. Nos. 3,933,672, issued Jan. 20, 1976 to Bartoletta et at., and 4,136,045, issued Jan. 23, 1979 to Gault et at., both incorporated herein by reference.

Suitable smectite clays for use herein are described in U.S. Pat. No. 4,762,645, Tucker et at, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et at, issued May 5, 1987, both incorporated herein by reference.

In order to make the present invention more readily understood, reference is made to the following examples, which are intended to be illustrative only and not intended to be limiting in scope.

EXAMPLES I–V

These Examples illustrate the process of the instant invention and the unexpected results associated with controlling agglomerate particle size by way of carbonate levels in the surfactant paste. While a batch mode of operation is illustrated herein, it is operated in a fashion to also simulate a continuous mode as it includes recycle fines and modified input amounts to the mixers. The following base composition is used in the process:

TABLE I

| Component | % Weight |
|---|---|
| Aluminosilicate | 37.5% |
| Sodium carbonate | 16.0% |
| Surfactant Paste[1] | 31.5% |
| Recycle fines[2] | 15.0% |
| | 100.0% |

[1]The various compositions for the surfactant paste are given herinafter
[2]The recycle fines have an overall composition as set forth in Table I, but with a particle size of less than about 300 microns. This addition of recycle fines simulates a large-scale production facility which may include such a recycle stream in a continuous process according to the process.

Table II presents five Example (I–V) surfactant paste compositions, each of which includes a different level of sodium carbonate at two different constant water levels (about 19% and 17% by weight respectively).

TABLE II

| | (% Weight) | | | | |
|---|---|---|---|---|---|
| Component | I | II | III | IV | V |
| $C_{14-17}$ alkyl sulfate | 55.56 | 52.97 | 52.33 | 53.66 | 54.51 |
| $C_{12-13}$ linear alkylbenzene sulfonate | 17.85 | 19.25 | 18.42 | 19.16 | 19.16 |
| Sodium hydroxide | 0.55 | 0.49 | 0.46 | 0.62 | 0.47 |
| Polyethylene glycol (M.W. = 4000) | 2.59 | 3.14 | 2.87 | 3.68 | 3.22 |
| Sodium carbonate | 0.16 | 0.53 | 1.10 | 0.50 | 1.16 |
| Water | 18.73 | 19.16 | 19.24 | 17.62 | 17.28 |
| Other (unreacted) | 4.56 | 4.46 | 5.58 | 4.76 | 4.20 |
| | 100.0 | 100.0 | 100.0 | 100.0 | 100.0 |

Each of Example surfactant paste compositions I–V are separately used as the surfactant paste in the base composition set forth in Table I and charged to a high speed mixer/densifier ("Pin Mixer" purchased from Processall, Inc.). The high speed mixer/densifer includes a 20.3 cm diameter horizontal rotating shaft (19.3 cm length, 1100 rpm) with 16 pins (1.3 cm diameter, 9.2 cm length) equally spaced on four rows on 90° centers and a 5.8 mm space between the pins and the mixer/densifier wall (jacket temperature 37° C.). Initially, the aluminosilicate, sodium carbonate and recycle fines which form the starting dry detergent ingredients are inputted into the aforementioned high speed mixer/densifier. In each Example run, the surfactant paste compositions are charged at a rate of 32.5 g/see (71° C.) to the high speed mixer/densifer. A total of 750 grams of the base composition is inputted to the high speed mixer/densifier for a residence time of about 12 seconds. Thereafter, a total of about 300 grams from the high speed mixer/densifier is fed into a moderate speed mixer/densifier (Tilt-A-Mixer™, Model 4HV commercially available from Processall, Inc.). The moderate speed mixer/densifier (jacket temperature 37° C.) has a shaft speed of 200 rpm and a residence time of 4 minutes. Detergent agglomerates are formed having a median particle size as determined by sieve analysis. The median particle size is dependent upon the particular Example surfactant paste composition I–V used, each of which has a different level of sodium carbonate.

The surprising results of varying the level of sodium carbonate in Example surfactant paste compositions I–V are presented in Table III below:

TABLE III

| | High Moisture | | | Low Moisutre | |
|---|---|---|---|---|---|
| | I | II | III | IV | V |
| Sodium carbonate (% weight) | 0.16 | 0.53 | 1.10 | 0.50 | 1.16 |
| Water (% weight) | 18.73 | 19.16 | 19.24 | 17.62 | 17.28 |
| Median agglomerate particle size (microns) | 1022 | 837 | 699 | 758 | 228 |

As can be seen from the results in Table III, the median particle size of the detergent agglomerates produced according to the process decreases as the level of sodium carbonate in the surfactant paste increases (at a set or constant water level). This result was unexpected in that the skilled artisan would have predicted the opposite since particle size should increase as the amount of carbonate increases, at a constant water level in the paste. The surprisingly result provides a lever or regulator for particle size in the process.

Having thus described the invention in detail, it will be clear to those skilled in the art that various changes may be made without departing from the scope of the invention and the invention is not to be considered limited to what is described in the specification.

What is claimed is:

1. A process for preparing detergent agglomerates comprising the steps of:

(a) inputting from about 5% to about 70% by weight of a detergency builder into a high speed mixer/densifier;

(b) charging a viscous surfactant paste into said high speed mixer/densifier, wherein said surfactant paste consisting essentially of, by weight of said surfactant paste, from about 70% to 95% of a mixture of alkyl sulfate and linear alkylbenzene sulfonate surfactants in a weight ratio of from about 1:1 to about 5:1 and from about 5% to about 30% of water;

(c) agglomerating said surfactant paste and said builder by treating said surfactant paste and said builder initially in said high speed mixer/densifier and subsequently in a moderate speed mixer/densifier so as to form detergent agglomerates having a particle size range of from about 300 to about 700 microns and undersized agglomerates having a particle size below said particle size range;

(d) regulating said detergent agglomerates within said particle size range by increasing the amount of sodium carbonate in said surfactant paste from about 0.5% to about 1.5%, by weight of said surfactant paste, to reduce the particle size of said detergent agglomerates; and (e) recycling said undersized agglomerates having a particle size below said particle size range which exit from said moderate speed mixer/densifier back into said high speed mixer/densifier.

2. The process of claim 1 wherein said regulating step the amount of said sodium carbonate is from about 0.5% to about 1.0%.

3. The process of claim 1 wherein said surfactant paste further includes from about 0.1% to about 10% by weight of polyethylene glycol.

4. The process of claim 1 wherein said particle size range is from about 300 to about 400 microns.

5. The process of claim 1 further comprising the step of drying said detergent agglomerates.

6. The process of claim 1 wherein said surfactant paste includes from about 15% to about 25% of water.

7. The process of claim 1 wherein said detergency builder is an aluminosilicate.

8. The process of claim 1 wherein said undersized agglomerates comprise from about 5% to about 30% by weight of said detergent agglomerates.

9. A process for preparing detergent agglomerates comprising the steps of:

(a) inputting from about 0.5% to about 40% by weight of an aluminosilicate and from about 5% to about 30% by weight of a first carbonate material into a high speed mixer/densifier;

(b) charging a viscous surfactant paste into said high speed mixer/densifier, wherein said surfactant paste consisting essentially of, by weight of said surfactant paste, from about 70% to 75 % of a detersive surfactant mixture of alkyl sulfate and linear alkylbenzene sulfonate and from about 15% to about 25% of water;

(c) agglomerating said surfactant paste and said builder by treating said surfactant paste, said first carbonate material, and said aluminosilicate initially in said high speed mixer/densifier and subsequently in a moderate speed mixer/densifier so as to form detergent agglomerates having a particle size range, of from about 300 to about 700 microns and undersized agglomerates having a particle size below said particle size range;

(d) regulating said detergent agglomerates within said particle size range by increasing the amount of a second carbonate material in said surfactant paste from about 0.5% to about 1.5%, by weight of said surfactant paste, to reduce the particle size of said detergent agglomerates; and (e) recycling said undersized agglomerates having a particle size below said particle size range which exit from said moderate speed mixer/densifier back into said high speed mixer/densifier.

10. The process of claim 9 wherein said first carbonate material and said second carbonate material are selected from the group consisting of sodium carbonate, calcium carbonate, potassium carbonate and mixtures thereof.

11. The process of claim 9 wherein said undersized agglomerates comprise from about 5% to about 30% by weight of said detergent agglomerates.

12. The process of claim 9 wherein the weight ratio of said alkyl sulfate to said linear alkylbenzene sulfonate surfactants in said surfactant mixture is about 3:1.

* * * * *